US009702550B2

(12) United States Patent
Colannino et al.

(10) Patent No.: US 9,702,550 B2
(45) Date of Patent: Jul. 11, 2017

(54) ELECTRICALLY STABILIZED BURNER

(71) Applicant: ClearSign Combustion Corporation, Seattle, WA (US)

(72) Inventors: Joseph Colannino, Bellevue, WA (US); Robert E. Breidenthal, Seattle, WA (US); Igor A. Krichtafovitch, Kirkland, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 1003 days.

(21) Appl. No.: 13/950,249

(22) Filed: Jul. 24, 2013

(65) Prior Publication Data

US 2014/0065558 A1 Mar. 6, 2014

Related U.S. Application Data

(60) Provisional application No. 61/675,079, filed on Jul. 24, 2012.

(51) Int. Cl.

| | |
|---|---|
| ***F23D 14/68*** | (2006.01) |
| ***F23D 14/62*** | (2006.01) |
| ***F23C 9/00*** | (2006.01) |
| ***F23C 99/00*** | (2006.01) |
| ***F23D 14/24*** | (2006.01) |
| ***F23D 14/70*** | (2006.01) |

(52) U.S. Cl.

CPC ..... *F23D 14/68* (2013.01); *F23C 9/00* (2013.01); *F23C 99/001* (2013.01); *F23D 14/24* (2013.01); *F23D 14/62* (2013.01); *F23D 14/70* (2013.01)

(58) Field of Classification Search

CPC ..... F23C 99/001; F23D 14/68
USPC ..... 431/3, 6, 8, 354
See application file for complete search history.

(56) References Cited

U.S. PATENT DOCUMENTS

| | | | |
|---|---|---|---|
| 1,153,182 | A | 9/1915 | Schniewind |
| 1,983,430 | A | 12/1934 | Ashcraft |
| 2,604,936 | A | 7/1952 | Kaehni et al. |
| 2,942,420 | A | 6/1960 | Clark |
| 3,087,472 | A | 4/1963 | Asakawa |
| 3,167,109 | A | 1/1965 | Wobig |
| 3,224,485 | A | 12/1965 | Blomgren et al. |
| 3,306,338 | A | 2/1967 | Wright et al. |

(Continued)

FOREIGN PATENT DOCUMENTS

| | | |
|---|---|---|
| EP | 0844434 | 5/1998 |
| FR | 2577304 | 12/1989 |

(Continued)

OTHER PUBLICATIONS

International Search Report and Written Opinion of International PCT Application No. PCT/US2013/052503 mailed Apr. 11, 2014.

(Continued)

*Primary Examiner* — Avinash Savani
*Assistant Examiner* — Aaron Heyamoto
(74) *Attorney, Agent, or Firm* — Christopher A. Wiklof; Launchpad IP, Inc.

(57) ABSTRACT

An electrically stabilized burner is configured to support a combustion reaction such as a combustion reaction substantially at a selected fuel dilution and with a mixing rate selected to maximize the reaction rate without quenching the combustion reaction.

34 Claims, 7 Drawing Sheets

(56) References Cited

U.S. PATENT DOCUMENTS

| | | | | |
|---|---|---|---|---|
| 3,358,731 | A | 12/1967 | Donnelly | |
| 3,416,870 | A | 12/1968 | Wright | |
| 3,503,348 | A | 3/1970 | Dvirka | |
| 3,749,545 | A | 7/1973 | Velkoff | |
| 3,841,824 | A | 10/1974 | Bethel | |
| 3,869,362 | A | 3/1975 | Machi et al. | |
| 4,052,139 | A | 10/1977 | Paillaud et al. | |
| 4,091,779 | A | 5/1978 | Saufferer et al. | |
| 4,093,430 | A | 6/1978 | Schwab et al. | |
| 4,110,086 | A | 8/1978 | Schwab et al. | |
| 4,111,636 | A | 9/1978 | Goldberg | |
| 4,118,202 | A | 10/1978 | Scholes | |
| 4,219,001 | A | 8/1980 | Kumagai et al. | |
| 4,260,394 | A | 4/1981 | Rich | |
| 4,304,096 | A | 12/1981 | Liu et al. | |
| 4,340,024 | A | 7/1982 | Suzuki et al. | |
| 4,362,016 | A | 12/1982 | Papadopulos | |
| 4,439,980 | A | 4/1984 | Biblarz et al. | |
| 4,644,783 | A | 2/1987 | Roberts et al. | |
| 4,649,260 | A | 3/1987 | Melis et al. | |
| 4,675,029 | A | 6/1987 | Norman et al. | |
| 4,903,616 | A | 2/1990 | Mavroudis | |
| 4,987,839 | A | 1/1991 | Krigmont et al. | |
| 4,995,805 | A | 2/1991 | Hilliard | |
| 5,620,616 | A | 4/1997 | Anderson et al. | |
| 5,702,244 | A | 12/1997 | Goodson et al. | |
| 5,784,889 | A | 7/1998 | Joos et al. | |
| 6,247,921 | B1 | 6/2001 | Helt | |
| 6,640,549 | B1 | 11/2003 | Wilson et al. | |
| 6,736,133 | B2 | 5/2004 | Bachinski et al. | |
| 6,742,340 | B2 | 6/2004 | Nearhoof, Sr. et al. | |
| 6,918,755 | B1 | 7/2005 | Johnson et al. | |
| 7,137,808 | B2 | 11/2006 | Branston et al. | |
| 7,159,646 | B2 | 1/2007 | Dessiatoun et al. | |
| 7,168,427 | B2 | 1/2007 | Bachinski et al. | |
| 7,182,805 | B2 | 2/2007 | Reaves | |
| 7,226,496 | B2 | 6/2007 | Ehlers | |
| 7,226,497 | B2 | 6/2007 | Ashworth | |
| 7,243,496 | B2 | 7/2007 | Pavlik et al. | |
| 7,377,114 | B1 | 5/2008 | Pearce | |
| 7,523,603 | B2 * | 4/2009 | Hagen | F01K 21/047 422/607 |
| 7,845,937 | B2 | 12/2010 | Hammer et al. | |
| 8,082,725 | B2 | 12/2011 | Younsi et al. | |
| 8,245,951 | B2 | 8/2012 | Fink et al. | |
| 9,284,886 | B2 | 3/2016 | Breidenthal | |
| 9,371,994 | B2 | 6/2016 | Goodson et al. | |
| 9,377,188 | B2 | 6/2016 | Ruiz et al. | |
| 9,377,189 | B2 | 6/2016 | Ruiz et al. | |
| 9,441,834 | B2 | 9/2016 | Colannino et al. | |
| 9,469,819 | B2 | 10/2016 | Wiklof | |
| 2004/0115577 | A1 | 6/2004 | Maenishi et al. | |
| 2005/0208442 | A1 * | 9/2005 | Heiligers | F23B 7/00 431/1 |
| 2006/0165555 | A1 | 7/2006 | Spielman et al. | |
| 2007/0020567 | A1 | 1/2007 | Branston et al. | |
| 2010/0183424 | A1 | 7/2010 | Roy | |
| 2011/0027734 | A1 | 2/2011 | Hartwick et al. | |
| 2011/0203771 | A1 | 8/2011 | Goodson et al. | |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 | 10/2013 | Goodson | |
| 2013/0255548 | A1 | 10/2013 | Goodson et al. | |
| 2013/0255549 | A1 | 10/2013 | Sonnichsen et al. | |
| 2013/0260321 | A1 | 10/2013 | Colannino et al. | |
| 2013/0323655 | A1 | 12/2013 | Krichtafovitch et al. | |
| 2013/0323661 | A1 | 12/2013 | Goodson et al. | |
| 2013/0333279 | A1 | 12/2013 | Osler et al. | |
| 2013/0336352 | A1 | 12/2013 | Colannino et al. | |
| 2014/0038113 | A1 | 2/2014 | Breidenthal et al. | |
| 2014/0050644 | A1 | 2/2014 | Colannino et al. | |
| 2014/0051030 | A1 | 2/2014 | Colannino et al. | |
| 2014/0065558 | A1 | 3/2014 | Colannino et al. | |
| 2014/0076212 | A1 | 3/2014 | Goodson et al. | |
| 2014/0080070 | A1 | 3/2014 | Krichtafovitch et al. | |
| 2014/0162195 | A1 | 6/2014 | Lee et al. | |
| 2014/0162196 | A1 | 6/2014 | Krichtafovitch et al. | |
| 2014/0162197 | A1 | 6/2014 | Krichtafovitch et al. | |
| 2014/0162198 | A1 | 6/2014 | Krichtafovitch et al. | |
| 2014/0170569 | A1 | 6/2014 | Anderson et al. | |
| 2014/0170571 | A1 | 6/2014 | Casasanta, III et al. | |
| 2014/0170575 | A1 | 6/2014 | Krichtafovitch | |
| 2014/0170576 | A1 | 6/2014 | Colannino et al. | |
| 2014/0170577 | A1 | 6/2014 | Colannino et al. | |
| 2014/0196368 | A1 | 7/2014 | Wiklof | |
| 2014/0208758 | A1 | 7/2014 | Breidenthal et al. | |
| 2014/0212820 | A1 | 7/2014 | Colannino et al. | |
| 2014/0216401 | A1 | 8/2014 | Colannino et al. | |
| 2014/0227645 | A1 | 8/2014 | Krichtafovitch et al. | |
| 2014/0227646 | A1 | 8/2014 | Krichtafovitch et al. | |
| 2014/0227649 | A1 | 8/2014 | Krichtafovitch et al. | |
| 2014/0248566 | A1 | 9/2014 | Krichtafovitch et al. | |
| 2014/0255855 | A1 | 9/2014 | Krichtafovitch | |
| 2014/0255856 | A1 | 9/2014 | Colannino et al. | |
| 2014/0272731 | A1 | 9/2014 | Breidenthal et al. | |
| 2014/0287368 | A1 | 9/2014 | Krichtafovitch et al. | |
| 2014/0295094 | A1 | 10/2014 | Casasanta, III | |
| 2014/0295360 | A1 | 10/2014 | Wiklof | |
| 2014/0335460 | A1 | 11/2014 | Wiklof et al. | |
| 2015/0079524 | A1 | 3/2015 | Colannino et al. | |
| 2015/0107260 | A1 | 4/2015 | Colannino et al. | |
| 2015/0118629 | A1 | 4/2015 | Colannino et al. | |
| 2015/0121890 | A1 | 5/2015 | Colannino et al. | |
| 2015/0140498 | A1 | 5/2015 | Colannino | |
| 2015/0147704 | A1 | 5/2015 | Krichtafovitch et al. | |
| 2015/0147705 | A1 | 5/2015 | Colannino et al. | |
| 2015/0147706 | A1 | 5/2015 | Krichtafovitch et al. | |
| 2015/0219333 | A1 | 8/2015 | Colannino et al. | |
| 2015/0241057 | A1 | 8/2015 | Krichtafovitch et al. | |
| 2015/0276211 | A1 | 10/2015 | Colannino et al. | |
| 2015/0338089 | A1 | 11/2015 | Krichtafovitch et al. | |
| 2015/0345780 | A1 | 12/2015 | Krichtafovitch | |
| 2015/0345781 | A1 | 12/2015 | Krichtafovitch et al. | |
| 2015/0362178 | A1 | 12/2015 | Karkow et al. | |
| 2016/0018103 | A1 | 1/2016 | Karkow et al. | |
| 2016/0033125 | A1 | 2/2016 | Krichtafovitch et al. | |
| 2016/0040872 | A1 | 2/2016 | Colannino et al. | |
| 2016/0091200 | A1 | 3/2016 | Colannino et al. | |
| 2016/0123576 | A1 | 5/2016 | Colannino et al. | |
| 2016/0161115 | A1 | 6/2016 | Krichtafovitch et al. | |
| 2016/0245507 | A1 | 8/2016 | Goodson et al. | |

FOREIGN PATENT DOCUMENTS

| | | |
|---|---|---|
| GB | 932955 | 7/1963 |
| GB | 1042014 | 9/1966 |
| JP | 58-019609 | 2/1983 |
| JP | 60-216111 | 10/1985 |
| JP | 61-265404 | 11/1986 |
| JP | 2001-021110 | 1/2001 |
| WO | WO 95/34784 | 12/1995 |
| WO | WO 96/01394 | 1/1996 |

OTHER PUBLICATIONS

Altendrfner et al., "Electric Field Effects on Emissions and Flame Stability With Optimized Electric Field Geometry", Third European Combustion Meeting ECM 2007, p. 1-6.

William T. Brande; "The Bakerian Lecture: On Some New Electro-Chemical Phenomena", Phil. Trans. R. Soc. Lond. 1814 104, p. 51-61

James Lawton and Felix J. Weinberg. "Electrical Aspects of Combustion". Clarendon Press, Oxford. 1969.

Timothy J.C. Dolmansley et al., "Electrical Modification of Combustion and the Affect of Electrode Geometry on the Field Produced," Modelling and Simulation in Engineering, May 26, 2011, 1-13, vol. 2011, Himdawi Publishing Corporation.

(56) References Cited

OTHER PUBLICATIONS

M. Zake et al., "Electric Field Control of NOx Formation in the Flame Channel Flows." Global Nest: The Int. J. May 2000, vol. 2, No. 1, pp. 99-108.

* cited by examiner

ELECTRICALLY STABILIZED BURNER

CROSS-REFERENCE TO RELATED APPLICATIONS

The present application claims priority benefit from U.S. Provisional Patent Application No. 61/675,079, entitled "ELECTRICALLY STABILIZED BURNER AND MIXER", filed Jul. 24, 2012, which, to the extent not inconsistent with the disclosure herein, is incorporated by reference.

SUMMARY

According to an embodiment, an electrically stabilized burner includes a conductive flame holder configured for mounting proximate a fuel jet and a charger disposed to cooperate with the conductive flame holder to cause a combustion reaction to be stabilized adjacent to the flame holder. A mixer is configured to mix fuel and oxidant, air, and/or flue gas above the conductive flame holder. The mixer is configured to mix the fuel and oxidant, air, and/or flue gas at a rate selected to maximize a rate of combustion reaction while avoiding quenching the combustion reaction. The charger can be a corona electrode or another ion source disposed to output electrical charges to the fuel, to an entrainment volume adjacent to the fuel stream and below the conductive flame holder, or to the oxidant, air, and/or flue gas subsequently mixed with the fuel or diluted fuel. Additionally or alternatively, the charger can be a charge electrode in electrical continuity with a conductive portion of the combustion reaction (e.g., in electrical continuity with a flame sheath).

According to an embodiment, a method for operating an electrically stabilized burner includes supporting a conductive flame holder proximate to a fuel jet at a distance along the fuel jet corresponding to a selected fuel dilution, applying a voltage or charge to a combustion reaction supported by the fuel jet, and stabilizing the combustion reaction proximate to the conductive flame holder responsive to at least an intermittent voltage difference between the combustion reaction and the conductive flame holder. The fuel is further mixed with oxidant, air, and/or flue gas above the conductive flame holder.

DETAILED DESCRIPTION

Figure 1:
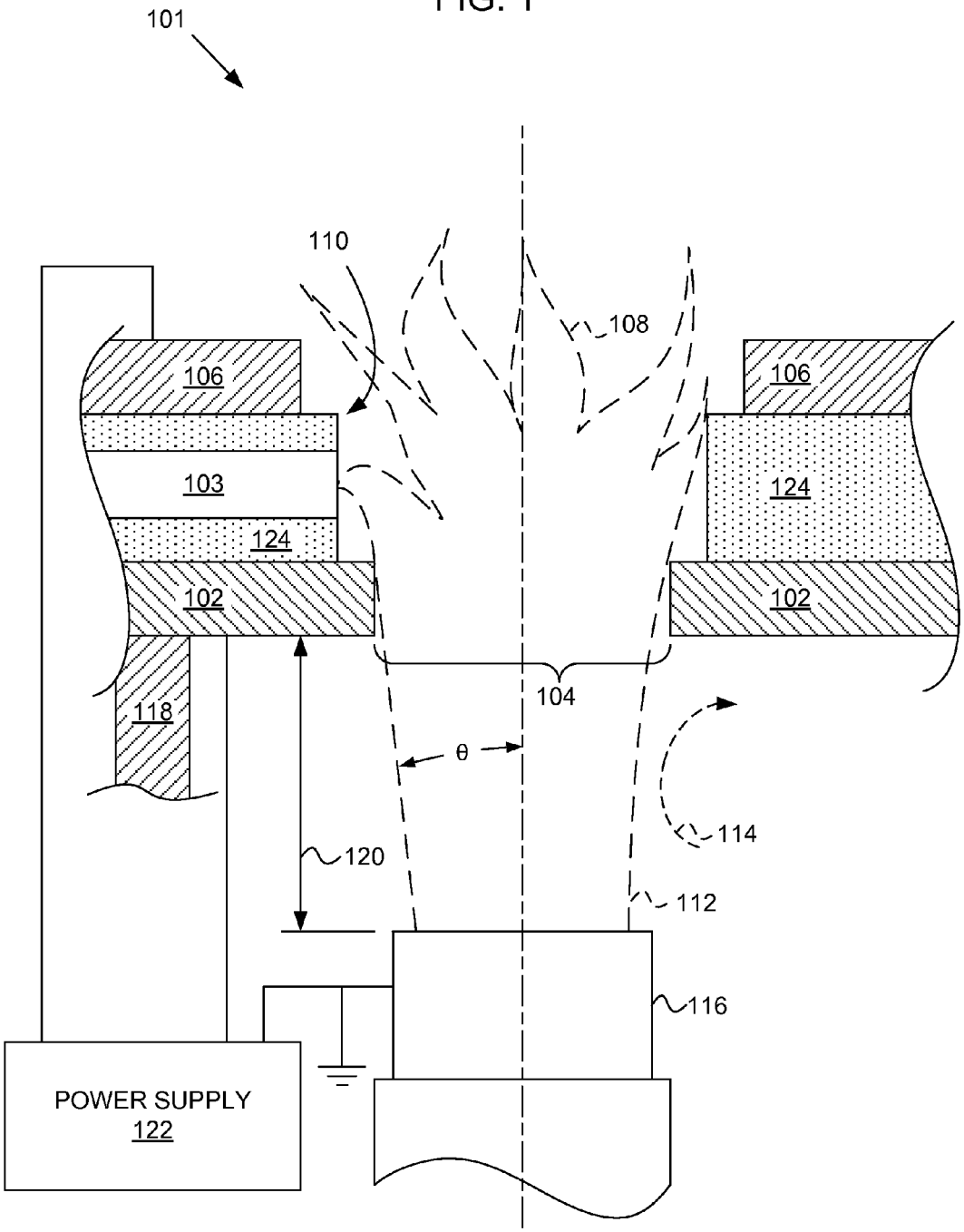
FIG. 1 is a side-sectional diagram of an electrically stabilized burner, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a side-sectional diagram of an electrically stabilized burner 101, according to an embodiment. A conductive flame holder 102 is configured for mounting proximate a fuel jet 112. A charger 106 (e.g., an electrode that is configured to apply an electrical charge) is disposed to cooperate with the conductive flame holder 102 to cause a combustion reaction 108 to be stabilized adjacent to the conductive flame holder 102. A mixer 110 is configured to mix fuel from the fuel jet 112 with oxidant, air, and/or flue gas above the conductive flame holder 102. For example, the mixer 110 can include of one or more fluid passages 103. The mixer 110 is configured to cause a high mixing rate (or minimize a mixing time) of the fuel with oxidant, air, and/or flue gas without quenching the combustion reaction 108.

The fuel jet 112 diverges at a substantially constant angle θ from a fuel nozzle 116. The angle of divergence θ of the fuel jet 112 is estimated to be a 7.5-degree angle of divergence from an axis of fuel transport. Alternatively, the angle of divergence can be referred to as a 15-degree solid angle (2θ). The fuel diverges from a point upstream from an aperture forming the fuel nozzle outlet such that the aperture coincides with the edges of the fuel jet at the point where the fuel stream exits the fuel nozzle 116.

The expansion in fuel jet area corresponds to dilution of the fuel by entrainment of a surrounding fluid 114. For example, the surrounding fluid 114 can include air and/or recycled flue gas. If the surrounding fluid 114 is air; for example, the entrained fluid can include about 21% oxygen, about 78% nitrogen and small amounts of other gases. If the surrounding fluid 114 includes a flue gas recycle; for example, the entrained fluid can include about 2% to about 5% oxygen, about 78% nitrogen, and various combustion products such as carbon dioxide, water vapor and other species found in the recycled flue gas. Recycling flue gas 114 for entrainment with the fuel jet 112 therefore can result in a lower concentration of oxygen mixed with the fuel.

It will be understood that the fuel jet 112 exiting the fuel nozzle 116 can itself include oxidant, air, flue gas, and/or another diluent. In embodiments, the fuel jet, as it exits the fuel nozzle 116, is either pure fuel or a fuel and oxidant mixture that is above the rich flammability limit of the fuel, such that a spark introduced at the fuel nozzle exit will not cause flashback into the fuel nozzle 116.

Reduced oxides of nitrogen (NOx) are output from a combustion reaction 108 supported by the electrically stabilized burner 101 compared to a combustion reaction that is not partially premixed by entrainment in a region 120 between the fuel nozzle 116 and the conductive flame holder 102. The electrical stabilization provided by the burner 101 allows a more stable and reliable combustion reaction, less prone to blow-out at lean operating conditions than a burner 101 that is not electrically stabilized.

A combustion reaction 108 burned near a lean flammability limit has a lower temperature than a combustion reaction 108 burned richer, and outputs less NOx than a combustion reaction 108 burned richer. Moreover, a well-mixed combustion reaction 108 tends to output less NOx than a poorly-mixed combustion reaction 108. The burner 101 provides both enhanced mixing (for reduced "prompt NOx") and leaner combustion (for reduced Zeldovich-mechanism (aka "thermal") NOx). Moreover, a high mixing rate provided by the mixer 110 minimizes high temperature residence time, which reduces NOx output.

A support structure 118 supports the conductive flame holder 102 at a selected distance 120 along the fuel jet 112. The distance 120 along the fuel jet 112 at which the conductive flame holder 102 is supported can be selected to correspond to be at a desired fuel dilution. For example, for a mixer 110 that does not introduce additional air or flue gas (for example, in embodiments corresponding to FIGS. 4-6), the distance 120 can be selected to provide the fuel jet 112 to the conductive flame holder 102 at or slightly richer than a lean flammability limit of the fuel under the operating conditions. Alternatively, for embodiments where the mixer 110 introduces additional dilution (for example, in embodiments corresponding to FIGS. 1, 2A, 2B, and/or 3), the distance 120 can be selected such that dilution by entrained air or flue gas 114 plus dilution by the mixer 110 provides a fuel mixture at or slightly richer than a lean flammability limit of the fuel under the operating conditions.

In an embodiment, the mixer 110 is configured to mix the fuel with oxidant, air, or flue gas at a mixing rate corresponding to a selected Damköhler number. Damköhler number (Da) is a dimensionless ratio of a mixing time to a chemical ignition delay time. At small Da (less than 1), the mixing time is shorter than chemical ignition delay time, and the combustion reaction is quenched by the cool reactants. This is because mixing occurs faster than the combustion reaction can release heat. At large Da (>>1) mixing time is greater than chemical ignition delay time. At large Da, the combustion reaction releases heat faster than (relatively cool) reactants are combined. Large Da combustion reactions are subject to detonation. Moreover, mixing at large Da is relatively inefficient, which causes combustion over a relatively large range of fuel dilutions and a relatively large range of fuel to oxidant ratios. A large range of fuel to oxidant ratios generally causes the combustion reaction to also exhibit a large range of combustion temperatures (with a correspondingly wide Boltzmann distribution). A large range of combustion temperatures is associated with high carbon monoxide and high NOx output, both of which are undesirable.

Da can alternatively be expressed as a ratio of the reaction rate to the convective mass transport rate, and is expressed in the equation $$Da = \frac{k_c C_0^n}{C_0/\tau} = k_c C_0^{(n-1)}\tau;$$

where $k_c$ is a reaction rate constant, $C_0$ is an initial concentration, n is the reaction order, and T is a mean residence time.

The selected Damköhler number can be equal to or greater than 1 without causing the combustion reaction 108 to be quenched. In an embodiment, the mixer 110 is operable to cause the selected Damköhler number to be between 1.1 and 1.7. In a particular embodiment, the mixer 110 is operable to cause the selected Damköhler number to be about 1.3. Running the mixer 110 at a Da greater than 1 can provide operating margin with respect to transient effects that could cause quenching of the combustion reaction 108.

The conductive flame holder 102 is shaped to define an aperture 104 configured to be supported peripherally and adjacent to the fuel jet 112. The mixer 110 can be operated to produce a Damköhler number selected to form a compact combustion reaction 108 disposed near the aperture 104. For example, the Damköhler number can be selected to form a compact combustion reaction disposed within the aperture 104.

In an embodiment, the charger 106 and the conductive flame holder 102 are configured to cooperate to maintain a current flow channel therebetween in the combustion reaction 108. The current flow channel stabilizes and holds the combustion reaction 108 adjacent to the conductive flame holder 102.

In an embodiment, a power supply 122 is operatively coupled to the charger 106 and configured to cause the charger 106 to apply current to the combustion reaction 108. Alternatively, the power supply 122 can be configured to cause the charger 106 to apply a time-varying current to the combustion reaction 108. A time-varying current corresponds to a time-varying charge concentration in the combustion reaction 108, which may be measured as a corresponding electrical potential. The time-varying charge can include a sign-varying charge. The time-varying charge can include a periodic charge waveform having a frequency from about 50 to about 10,000 Hertz. In another embodiment, the time-varying charge can include a periodic charge waveform having a frequency from about 200 to about 800 Hertz. The time-varying charge can include, for example, a square waveform, sine waveform, triangular waveform, truncated triangular waveform, sawtooth waveform, logarithmic waveform, exponential waveform or other arbitrary shape. The inventors have found that waveforms with sharp edges (e.g., square, triangular, or sawtooth waveforms) tend to cause higher visibility (more easily observable) effects in combustion reactions 108.

In an embodiment, the charger 106 includes a charge electrode 106 configured to be disposed proximate to the combustion reaction 108. The power supply 122 is configured to apply a voltage to the charge electrode 106. The power supply 122 can be configured to apply a substantially constant voltage or a time-varying voltage, to the charge electrode 106. The time-varying voltage can include a sign-varying voltage. The time-varying voltage can include a periodic voltage waveform having a frequency of about 50 to about 10,000 Hertz. For example, the periodic voltage waveform can have a frequency of about 200 to about 800 Hertz. The time-varying voltage can include a square waveform, sine waveform, triangular waveform, truncated triangular waveform, sawtooth waveform, logarithmic waveform, or exponential waveform. The time-varying voltage applied to the charge electrode 106 includes a waveform having an amplitude of about ±1,000 volts to about ±115,000 volts. For example, the time-varying voltage includes a waveform having an amplitude of about ±8,000 volts to about ±40,000 volts.

The power supply 122 also is operatively coupled to the conductive flame holder 102. The power supply 122 is configured to apply a different voltage to the conductive flame holder 102 than to a charger (e.g., charge electrode 106). For example, the conductive flame holder 102 can be held at ground potential. According to an embodiment, the conductive flame holder 102 can be galvanically isolated from voltages other than voltages corresponding to charges received from the combustion reaction 108. The power supply 122 can be additionally or alternatively operatively coupled to the fuel nozzle 116. The fuel nozzle 116 is generally held at ground potential. Alternatively, the fuel nozzle 116 can be galvanically isolated from voltages other than voltages corresponding to charges received from the charger 106 through the combustion reaction 108. In embodiments, the fuel nozzle 116 is held in electrical continuity with the conductive flame holder 102.

Optionally, the power supply 122 is configured to apply to the conductive flame holder 102 and/or the fuel nozzle 116 one or more voltages opposite in polarity from charges applied to the combustion reaction 108 by the charger 106. Driving the conductive flame holder 102 to a voltage opposite in polarity to the charges applied to the combustion reaction 108 can provide greater flame attraction to the conductive flame holder 102, and hence greater flame stability compared to holding the conductive flame holder 102 at ground potential. Voltages applied by the power supply 122 can be selected dynamically, for example with larger voltages (and in particular, a larger voltage difference between the charger 106 and the conductive flame holder 102) being applied at higher fuel flow rates. In an embodiment, the power supply 122 is configured to drive the charger 106 to maintain a capacitance-coupled voltage relationship between the charger 106 and the conductive flame holder 102.

The electrically stabilized burner 101 can include an electrical insulator 124 disposed between the conductive flame holder 102 and the charger 106. The mixer 110 can be formed integrally with the electrical insulator 124.

Figure 2A:
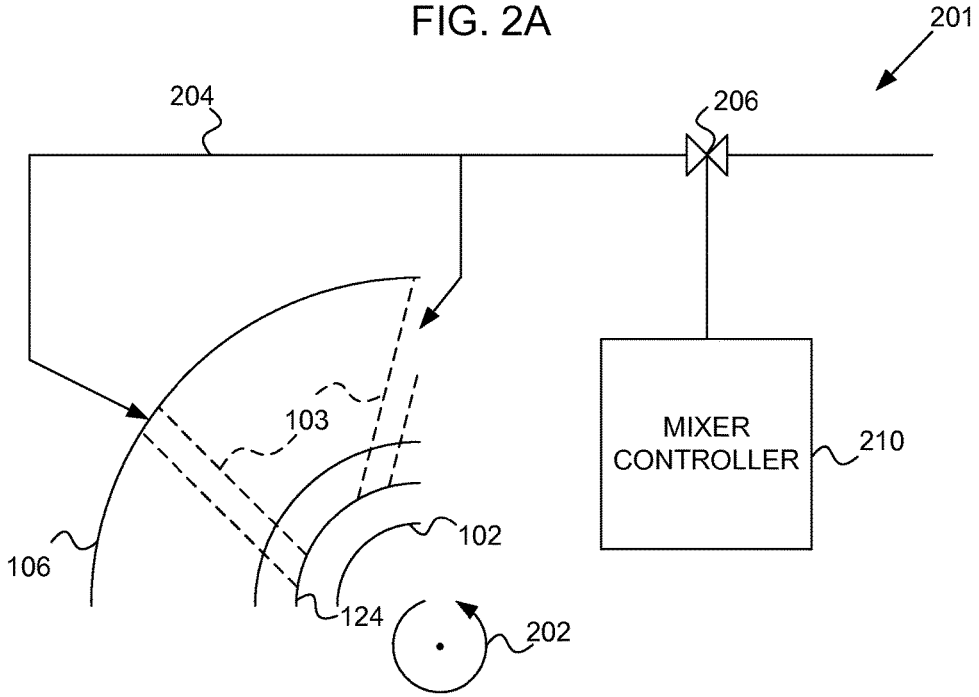
FIG. 2A is a plan view of a portion of the electrically stabilized burner of FIG. 1 with a block diagram of a mixer controller, according to an embodiment.
Figure 2B:
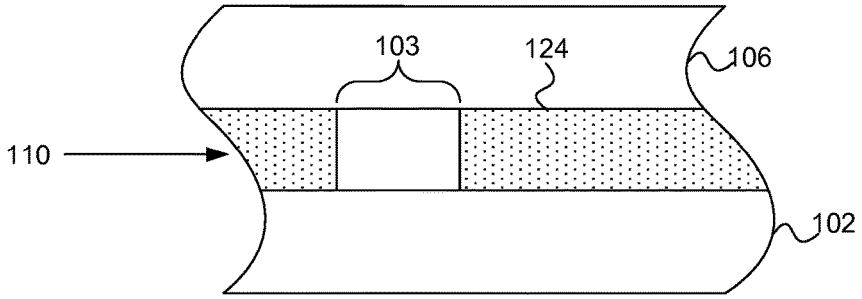
FIG. 2B is a side view of a portion of the electrically stabilized burner corresponding to FIG. 2A, according to an embodiment.

FIG. 2A is a plan view 201 of a portion of the electrically stabilized burner 101 of FIG. 1, according to an embodiment. FIG. 2B is a side view of a portion of the electrically stabilized burner corresponding to FIG. 2A, according to an embodiment. The mixer 110 further includes one or more fluid passages 103 entering aperture 104 tangentially so as to be configured to impart rotational velocity to impart a stream-wise vortex 202 onto the combustion reaction 108. The one or more fluid passages 103 can be arranged to drive the combustion reaction 108 in the stream-wise vortex 202. A fluid manifold 204 is configured to supply the mixing fluid to the one or more fluid passages 103. The rate of mixing is controlled according to a fluid flow rate through the fluid manifold 204 responsive to a flow control valve 206. A mixer controller 210 is configured to operate the control valve 206 to control the flow of fluid and the rate of mixing. The fluid includes oxidant (e.g., included in any or all of oxygen, air, and flue gas), and/or fuel. Fluid jets projected by the one or more fluid passages 103 can optionally be configured to act as a pilot flame if the main fuel jet 112 is reduced or stopped.

Figure 3:
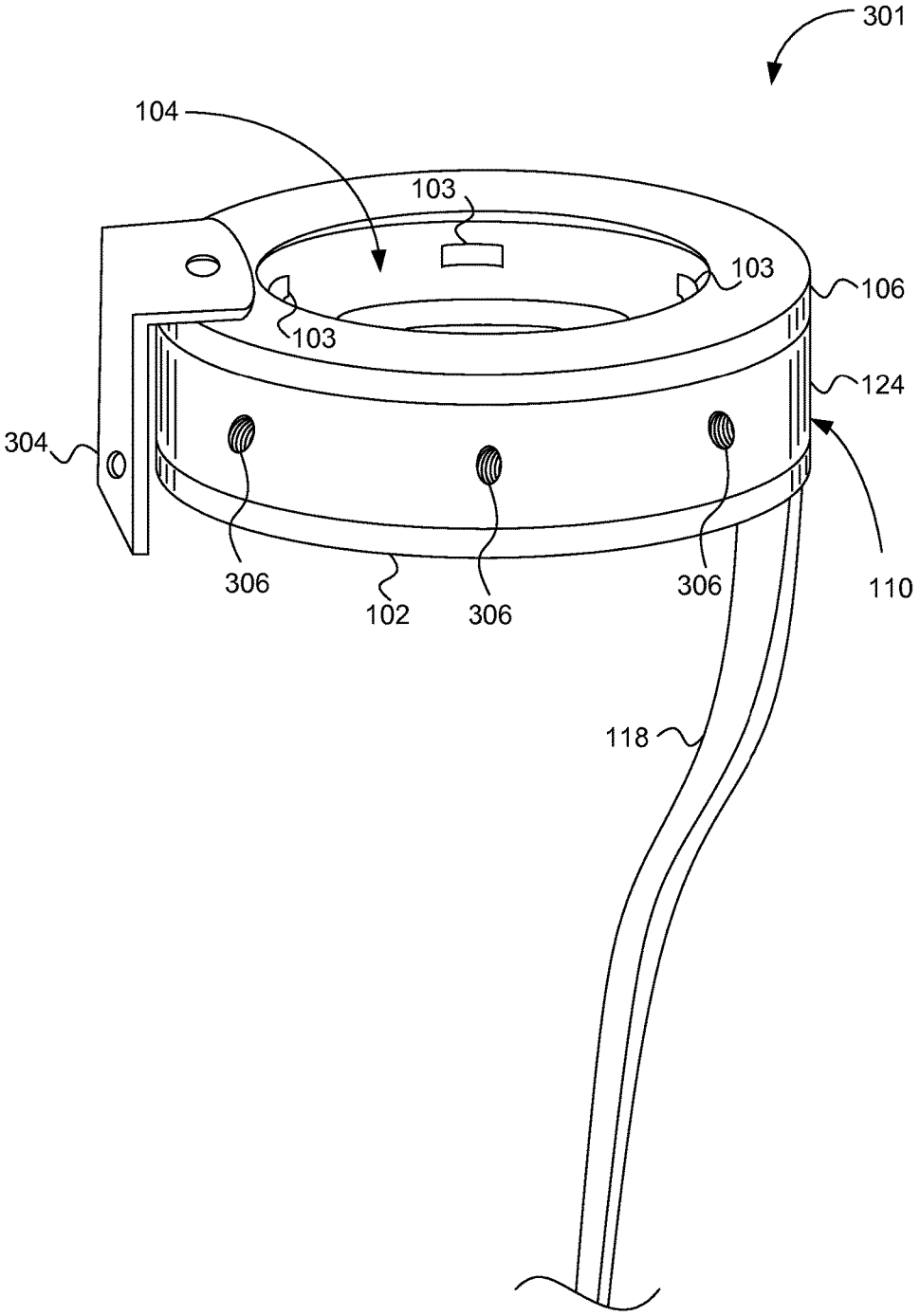
FIG. 3 is a perspective view of at least a portion of an electrically stabilized burner, according to an embodiment.

FIG. 3 is a perspective view of a portion of an electrically stabilized burner 301, according to an embodiment. The electrically stabilized burner 301 includes a support structure 118 configured to hold the conductive flame holder 102 at a selected distance from a fuel nozzle 116. As described, the distance can be selected to correspond to a desired fuel and oxidant, air, and/or flue gas mixture. An electrical insulator 124 can be disposed between the conductive flame holder 102 and a charger 106. (Optionally, the charger 106 and the conductive flame holder 102 can be separated by an air gap.) In the embodiment 301, the mixer 110 includes one or more fluid passages 103 formed into or through the electrical insulator 124 so as to output a mixing fluid substantially tangentially to the periphery of the aperture 104 defined by the electrical insulator 124. The conductive flame holder 102, the fuel nozzle 116, and the support structure 118 are configured as an integrated unit. Fittings 306 are formed to accept coupling to a fluid manifold (204 shown schematically in FIG. 2). An electrical lug 304 in electrical continuity with the charger 106 is configured for operative coupling to a lead (not shown) from a power supply 122. Some or all of the fuel nozzle 116, support structure 118, conductive flame holder 102, electrical insulator 124, fluid passages 103, charger 106, and electrical lug 304 can be formed as an integrated unit.

Various mixer embodiments are contemplated. The embodiments of FIGS. 1, 2A, 2B, and 3 show mixers formed as vortex-generating jet nozzles. As described, oxidant, air, flue gas, or fuel, alone or in combination, can be passed through the one or more fluid passages 103. Alternatively, the mixer 110 can include a plurality of electrodes configured to impart rotational force on charged particles carried by the combustion reaction 108. The resulting movement of the charged particles can, in turn, convey momentum to uncharged particles in the combustion reaction 108.

Figure 4:
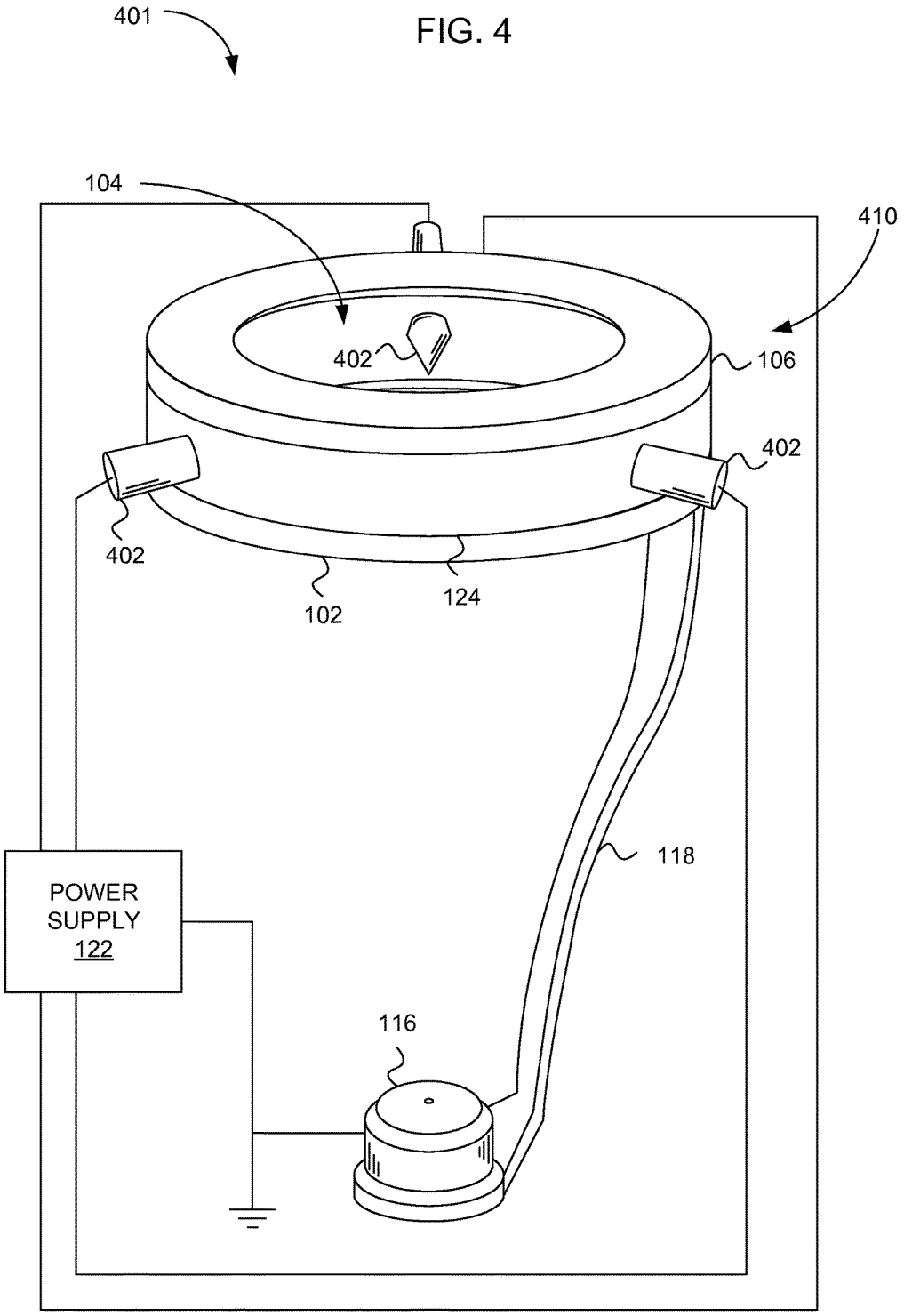
FIG. 4 is a simplified perspective view of an electrically stabilized burner, according to another embodiment.

FIG. 4 is a simplified perspective view of an electrically stabilized burner 401, according to another embodiment. A mixer 410 includes a plurality of field electrodes 402 operatively coupled to one or more power supplies 122 and disposed between the charger 106 and the conductive flame holder 102. The plurality of field electrodes 402 can be carried by an electrical insulator 124 or can alternatively be supported within an air gap between the charger 106 and the conductive flame holder 102. The actual number of field electrodes used can be fewer or greater than three. A mixer controller (not shown) is operatively coupled to the one or more power supplies 122. The mixer controller is configured to cause the one or more power supplies 122 to sequentially apply driving voltages to the field electrodes 402. The mixer controller is configured to drive the field electrodes 402 in a manner selected to cause the field electrodes 402 to mix fuel with oxidant, air, and/or flue gas at a selected rate of mixing. For example, the mixer controller can be configured to drive the field electrodes 402 in a sequence selected to cause the field electrodes 402 to sequentially attract and repel charged particles corresponding to a majority polarity of charged particles carried by combustion reaction 108 (the majority polarity of charged particles being supplied by the charger 106). The sequential driving of the charged particles causes circulation of the charged particles and a corresponding stream-wise vortex in the aperture defined by the conductive flame holder 102, field electrodes 402, electrical insulator 124, and/or the charger 106. The resultant circulation of the combustion reaction 108 causes mixing of the fuel with oxidant, air, and/or flue gas at the selected rate.

Approaches to electrical vortex generation are described in the U.S. patent application Ser. No. 12/753,047, entitled "SYSTEM AND APPARATUS FOR APPLYING AN ELECTRIC FIELD TO A COMBUSTION VOLUME", filed Apr. 1, 2010, which is incorporated by reference in its entirety. Compared to the approaches described in U.S. patent application Ser. No. 12/753,047, disclosure herein provides vortex generation by acting on a combustion reaction that carries a majority charge. The majority charge can reduce the amount of rotational inertia that is resisted by charged particles having opposite polarity to the majority charge. For example, for a positively charged combustion reaction, a relatively higher concentration of positively charged particles can be circulated under the influence of the field electrodes 402 than the number that are available in a neutral combustion reaction.

The voltage applied to the charger 106 by the power supply 122 can be substantially constant. Alternatively, the voltage applied to the charger 106 by the power supply 122 can be time varying. For example, the time varying voltage can include a periodically varying sign voltage, such as an AC voltage. For an embodiment where a periodically sign-varying voltage is applied to the charger 106, the sequential voltages applied to the field electrodes 402 are also be modified or be made intermittent such that the rotational direction of majority charges in the combustion reaction 108 (not shown) is maintained when the polarity of the majority charge inverts.

The electrical insulator 124 and the field electrodes 402 can form an integrated unit or a portion of an integrated unit 401. Some or all of the fuel nozzle 116, support structure 118, conductive flame holder 102, electrical insulator 124), field electrodes 402, charger 106, and/or electrical lug(s) (not shown) can be formed as an integrated unit 401.

Figure 5:
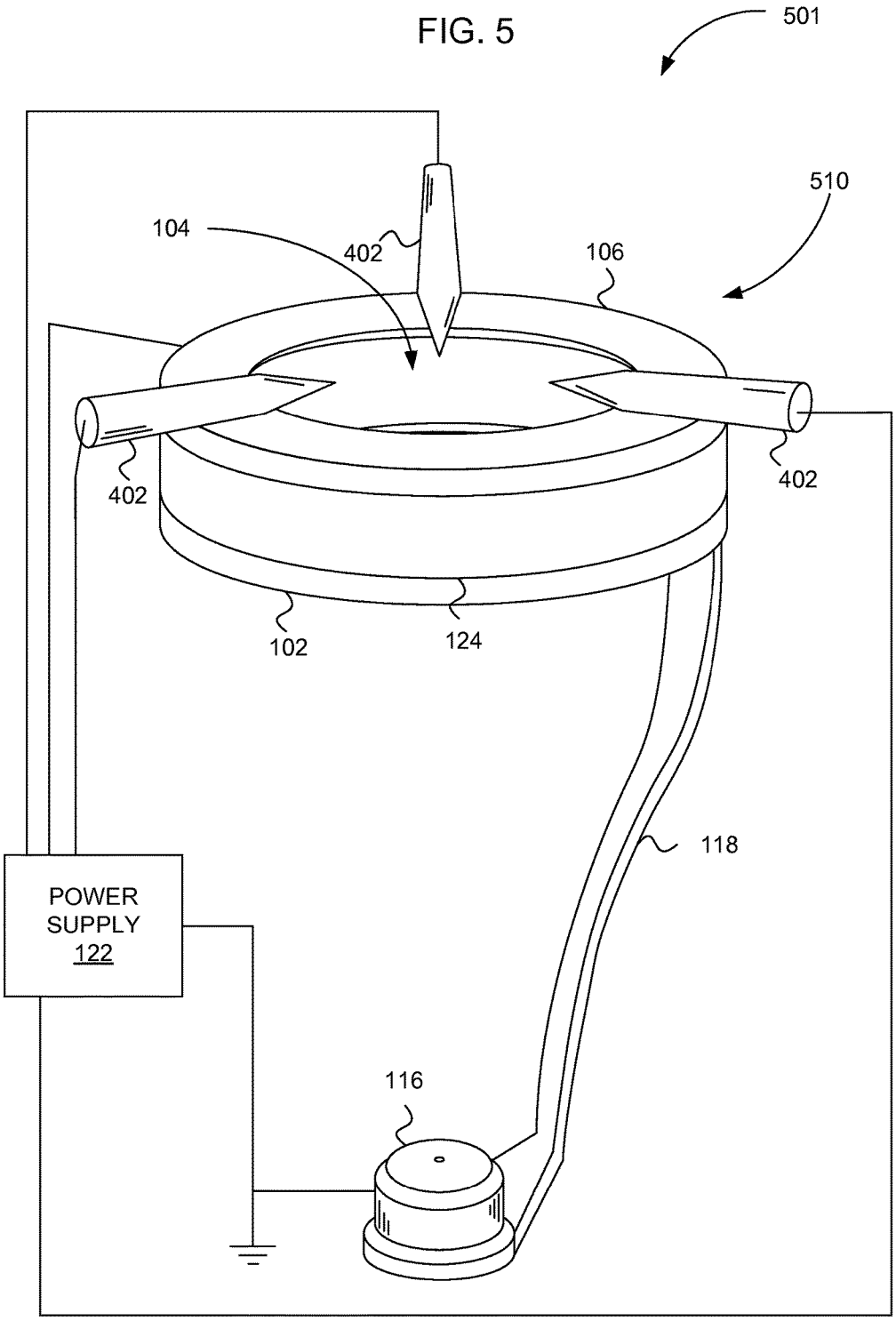
FIG. 5 is a simplified perspective view of an electrically stabilized burner, according to another embodiment.

FIG. 5 is a simplified perspective view of an electrically stabilized burner 501, according to another embodiment. Compared to the embodiment 401 of FIG. 4, in the embodiment 501, the relative locations of the field electrodes 402 and the charger 106 are reversed. A mixer 510 includes a plurality of field electrodes 402 operatively coupled to at least one power supply 122. The charger 106 is disposed between the field electrodes 402 and the conductive flame holder 102. For purposes of illustration, only three field electrodes 402 are shown but more or fewer field electrodes 402 are possible. The mixer controller (not shown) is operatively coupled to at least one power supply 122 and configured to cause the power supply(ies) 122 to apply driving voltages to the field electrodes 402. The mixer controller 210 is configured to cause the power supply(ies) to drive the field electrodes 402 in a manner selected to cause the field electrodes 402 to mix fuel with oxidant, air, and/or flue gas at a selected rate of mixing. For example, the power supply(ies) 122 can drive the field electrodes 402 in a sequence selected to cause the field electrodes 402 to sequentially attract and repel charged particles corresponding to a majority polarity of charged particles carried by combustion reaction 108. The sequential driving of the charged particles can cause circulation of the charged particles and a corresponding stream-wise vortex in an aperture defined by the conductive flame holder 102, field electrodes 402, electrical insulator 124, and/or the charger 106. The resultant circulation of the combustion reaction 108 causes mixing of the fuel with oxidant, air, and/or flue gas at the selected rate.

The voltage applied to the charger 106 by the first power supply 122 can be substantially constant. Alternatively, the voltage applied to the charger 106 by the power supply 122 can be time varying. For example, the time varying voltage can include a periodically varying sign voltage, such as an AC voltage. For an embodiment where a periodically sign-varying voltage is applied to the charger 106, the sequential voltages applied to the field electrodes 402 are also be modified or be made intermittent such that the rotational direction of the combustion reaction 108 is maintained when the majority charge polarity is inverted.

The field electrodes 402 can be at least partially carried by a second electrical insulator (not shown). The second electrical insulator and the field electrodes 402 can form an integrated unit or a portion of an integrated unit 401. Some or all of the fuel nozzle 116, support structure 118, conductive flame holder 102, first and second electrical insulator(s), field electrodes 402, and/or charger 106 can be formed as an integrated unit 501.

Figure 6:
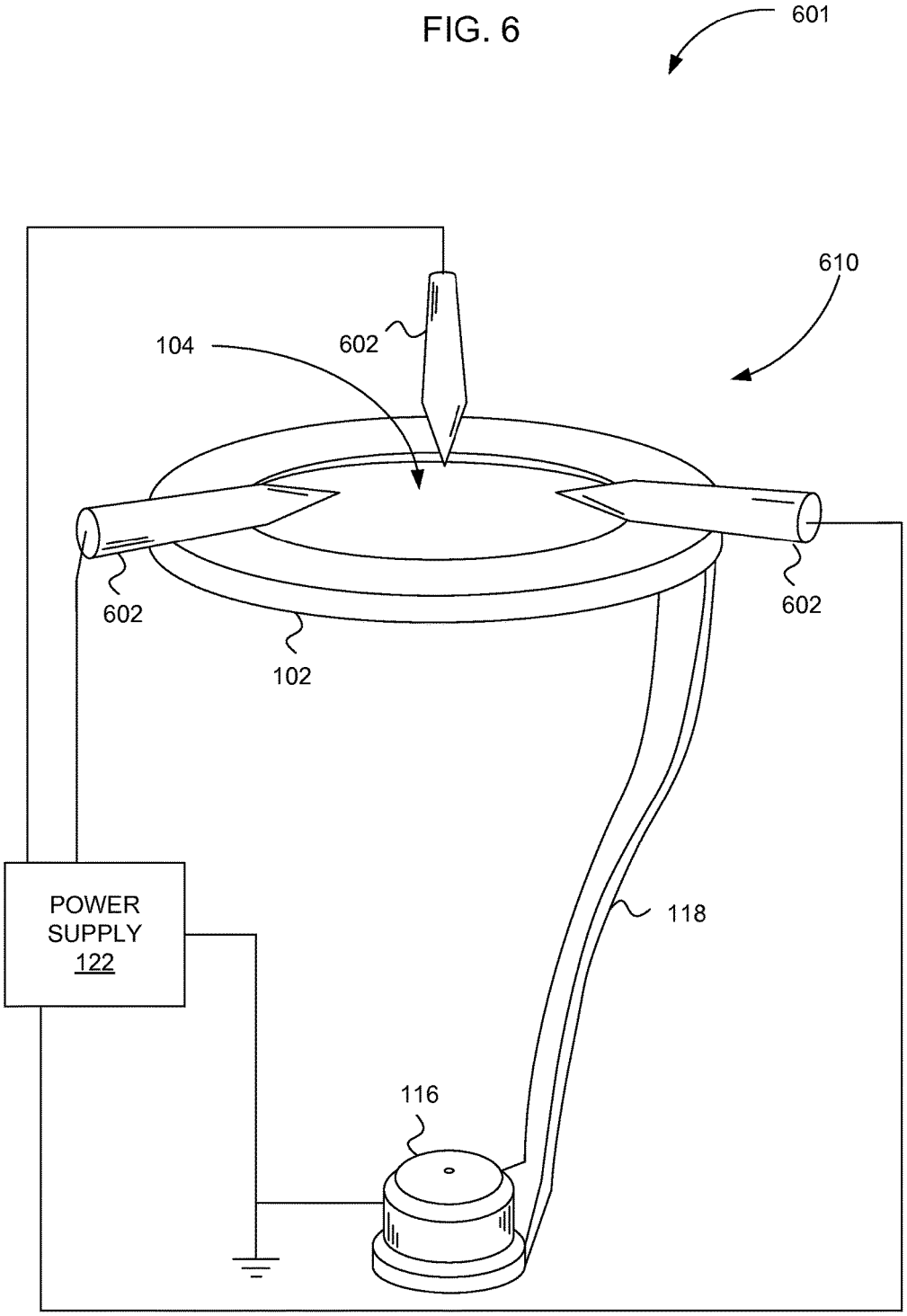
FIG. 6 is a simplified perspective view of an electrically stabilized burner, according to another embodiment.

FIG. 6 is a simplified perspective view of an electrically stabilized burner 601, according to another embodiment. Compared to the embodiments 401 and 501 shown in FIG. 4 and FIG. 5 respectively, in the embodiment illustrated by 601, a separate charger 106 is omitted. The function of the charger 106 is performed by an integrated field and charge electrodes 602. The mixer 610 includes a plurality of field and charge electrodes 602 operatively coupled to a power supply 122. For purposes of illustration, three field and charge electrodes 602 are shown but the actual number of field and charge electrodes 602 can be different. A mixer controller (not shown) is operatively coupled to one or more power supplies 122 configured to apply driving voltages to the field and charge electrodes 602. The mixer controller 210 is configured to cause the power supply(ies) 122 to apply a bias voltage to the field and charge electrodes 602 superimposed over electrode sequence voltages similar to those described in embodiments illustrated in FIGS. 4 and 5. The electrode sequence voltages sequentially attract and repel charged particles corresponding to a majority polarity of charged particles carried by combustion reaction 108. The bias voltage causes the combustion reaction to carry the majority polarity. As with a conventional charger, the concentration of charges carried by the combustion reaction (which may be measured as a voltage) is proportional to the bias voltage.

The bias voltage can be substantially constant. Alternatively, the bias voltage can be time varying. For example, the time varying voltage can include a periodically varying sign voltage, such as an AC voltage. For an embodiment where a periodically sign-varying bias voltage is applied to the field and charge electrodes 602, the sequential voltages (superimposed over the bias voltage) applied to the field and charge electrodes 602 can also be modified or be made intermittent such that the rotational direction of the combustion reaction is maintained.

The mixer controller is configured to cause the power supply(ies) 122 to drive the field and charge electrodes 602 in a manner selected to cause the field and charge electrodes 602 to mix the fuel with the oxidant, air, and/or flue gas at a selected rate of mixing. The sequential driving of the charged particles can cause circulation of the charged particles and a corresponding stream-wise vortex 202 in an aperture 104 defined by the conductive flame holder 102, field and charge electrodes 602 and/or electrical insulator (not shown). The resultant circulation of combustion reaction causes mixing of the fuel with oxidant, air, and/or flue gas at the selected rate.

The field and charge electrodes 602 can be at least partially carried by an electrical insulator (not shown). The electrical insulator and the field and charge electrodes 602 can form an integrated unit or a portion of an integrated unit 601. Some or all of a fuel nozzle 116, support structure 118, conductive flame holder 102, one or more electrical insulator(s) (not shown), and field and charge electrodes 602 can be formed as an integrated unit 601.

Optionally, any of electrically stabilized burner embodiments 101, 201, 301, 401, 501, and 601 can additionally include a second mixer (not shown) configured to mix fuel with oxidant, air, and/or flue gas below the conductive flame holder 102.

Figure 7:
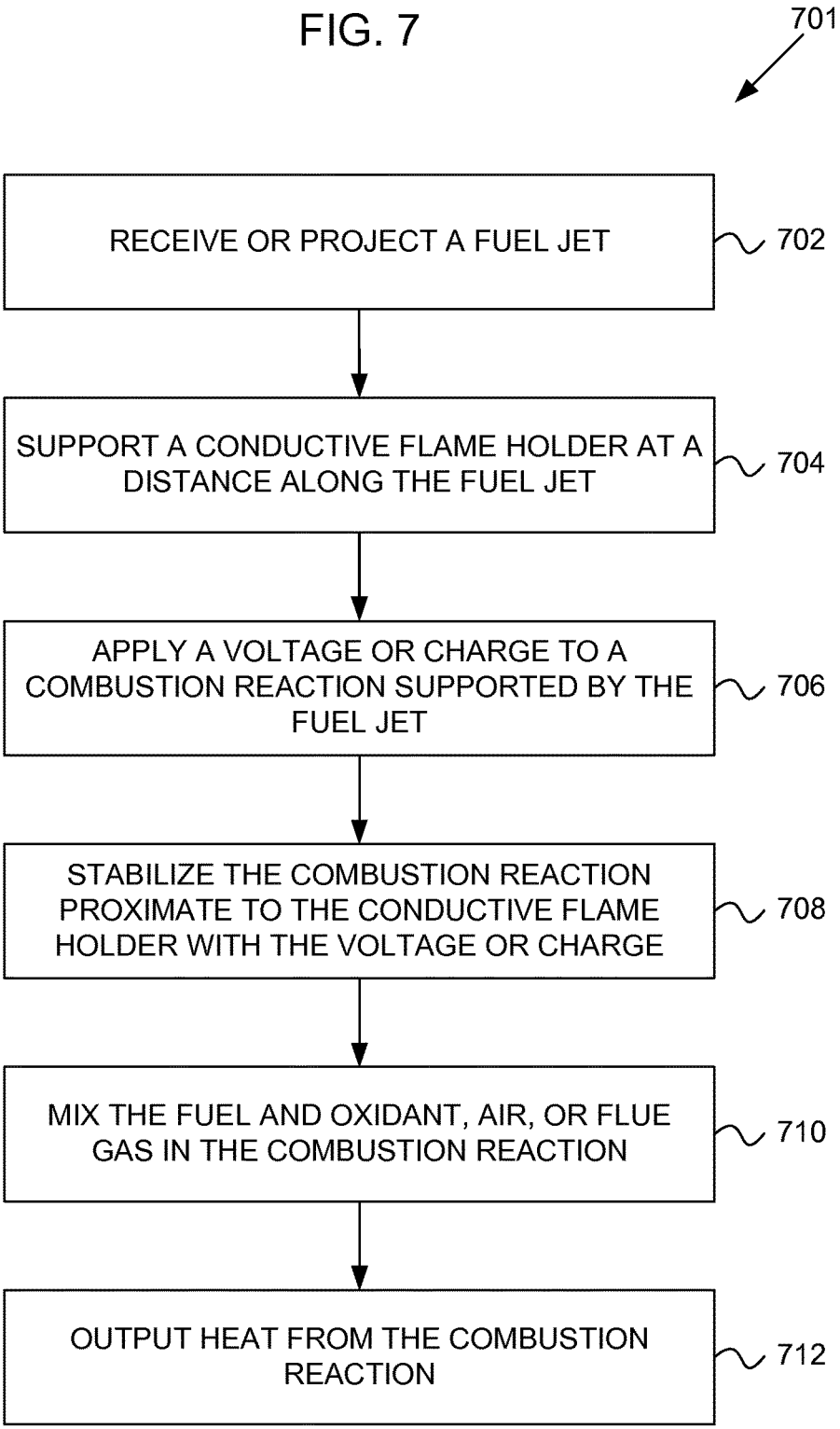
FIG. 7 is a flowchart showing a method for operating an electrically stabilized burner, according to an embodiment.

FIG. 7 is a flowchart showing a method 701 for operating an electrically stabilized burner, according to an embodiment. A fuel jet is projected in step 702. A fuel jet typically diverges from a nozzle at about a 7.5° half angle (15° solid angle). The divergence corresponds to the entrainment of gas or gases adjacent to the fuel jet. For example, oxidant, air, and/or flue gas can be entrained in the fuel jet. The entrainment reduces the concentration of the fuel within the gas stream. For a given fuel and entrained gas, the resultant ratio of fuel to oxidant can be a determinate function of distance along the fuel jet. In a low nitrogen oxide (NOx) burner, for example, it can be advantageous to maintain combustion at a narrow range of fuel dilution at or near a lean flammability limit of the fuel. Step 702 includes entraining oxidant, air, and/or flue gas, in the fuel jet.

Step 704 includes supporting a conductive flame holder proximate to a fuel jet at a distance along the fuel jet from the fuel nozzle corresponding to a selected fuel dilution. The selected fuel dilution can correspond substantially to a lean flammability limit of the fuel. Alternatively, supporting a conductive flame holder proximate to a fuel jet at a distance along the fuel jet corresponding to a selected fuel dilution can include supporting the conductive flame holder at a distance such that the dilution in the fuel caused by entrainment (and corresponding to fuel jet expansion) between the fuel nozzle and the conductive flame holder plus the dilution of the fuel caused by subsequent mixing results in a selected fuel dilution near the lean flammability limit of the fuel.

Optionally, the method 701 can include the step (not shown) of selecting a fuel dilution. For example, at start-up, a furnace or boiler using the burner can be operated at a relatively rich fuel mixture. A richer fuel mixture is generally more stable when a combustion chamber is cool. Later, after a warm-up period, the fuel dilution can be increased such that the fuel is burned near its lean flammability limit. As described above, operating a burner near the lean flammability limit of the fuel is generally associated with a cooler combustion reaction, and a cooler combustion reaction is generally associated with reduced NOx output. The method 701 can further include (not shown) adjusting the distance along the fuel jet at which the conductive flame holder is supported, wherein the distance corresponds to the selected fuel dilution.

Alternatively, the burner described herein can be operated primarily when the furnace or boiler is cool. Later, after the combustion chamber is warmed-up, the combustion reaction can lift from the conductive flame holder to be held at a larger distance from the fuel nozzle by an aerodynamic flame holder (e.g., a bluff body). The combustion reaction can be lifted by removing application of the voltage or charge applied in step 706, or responsive to higher temperatures that cause the conductive flame holder to be less effective at holding the combustion reaction (at a given applied voltage).

Proceeding to step 706, a voltage or charge is applied to a combustion reaction supported by the fuel jet. For example, a charger can be disposed near the combustion reaction and raised to a potential to inject a charge into the combustion reaction. According to embodiments, applying a voltage or charge to the combustion reaction includes applying a voltage to the charger.

Applying a voltage or charge to the combustion reaction can include the application of a constant voltage to the charger, and hence a substantially constant current to the combustion reaction. The inventors have found that a high voltage (high voltage is defined as equal to or greater than ±1000 volts) should be applied to the charger in order to inject sufficient charge to cause the described phenomena. Either positive or negative voltage may be applied to the combustion reaction. In some experiments, positive voltage was found to be somewhat more effective at holding the flame compared to an equal magnitude negative voltage. In an embodiment, +15,000 volts was applied to a charger formed as a charge electrode in electrical contact with a conductive flame, and the conductive flame holder (described in step 708 below) was held at ground potential. For more demanding conditions (e.g., hotter furnace temperature and/or higher fuel flow velocity), the conductive flame holder can be held at a voltage opposite in polarity to the applied charge polarity. The inventors contemplate a wide range of effective voltages. For example, voltages of ±1000 volts to about ±115,000 volts can be applied to the charger. More particularly, ±8000 volts to about ±40,000 volts can be applied to the charger. At +15,000 volts, current is typically in the range of hundreds of microamps up to hundreds of milliamps. A power supply capable of delivering a maximum power of about 15 Watts to 1500 Watts is generally appropriate, depending on operating conditions. Lower power is required at cooler furnace temperatures and at fuel flow rates corresponding to about 150,000 BTU/hour output.

Alternatively, applying a voltage or charge to the combustion reaction in step 706 can include applying a time-varying voltage or charge to the combustion reaction. For example, a time-varying voltage can be applied to a charger. The time-varying voltage can include a periodic voltage waveform having a frequency of about 50 to about 10,000 Hertz. For example, the time-varying voltage can include a periodic voltage waveform having a frequency of about 200 to about 800 Hertz. Applying the time-varying voltage can include applying a square waveform, sine waveform, triangular waveform, truncated triangular waveform, sawtooth waveform, logarithmic waveform, and/or exponential waveform to the charger. The waveform can also have an amplitude of about ±1000 volts to about ±115,000 volts. For example, the waveform can have an amplitude of about ±8000 volts to about ±40,000 volts.

Step 706 includes holding the conductive flame holder at a voltage different than the voltage or charge applied to the combustion reaction. Applying a voltage or charge to the combustion reaction can includes applying a time-varying voltage or charge to the combustion reaction and applying a second time-varying voltage to the conductive flame holder, the second time-varying voltage being instantaneously opposite in polarity from the time-varying voltage or charge applied to the combustion reaction. Alternatively, the conductive flame holder can be held substantially at a ground potential, or can be galvanically isolated from ground and from voltages other than the voltage applied to the charger.

Step 708 includes stabilizing a combustion reaction supported by the fuel jet proximate to the conductive flame holder. The stabilization can be responsive to at least an intermittent voltage difference between the combustion reaction and the conductive flame holder. For example, step 708 can include exciting at least an intermittent plasma state in the fuel jet responsive to the at least intermittent voltage difference between the combustion reaction and the conductive flame holder. The plasma state can maintain fuel ignition in some embodiments.

Step 710 includes mixing the fuel with oxidant (e.g. oxygen), air, and/or flue gas above the conductive flame holder. The fuel and oxidant, air, and/or flue gas can be mixed to maintain a selected Damköhler number at a location corresponding to the combustion reaction. The selected Damköhler number can be greater than or equal to 1. For example, the selected Damköhler number can be in the range from about 1.1 to about 1.7.

In step 710, mixing the oxidant, air, and/or flue gas and the fuel includes imparting rotational inertia on the combustion reaction. The rotational inertia can be imparted by injecting one or more jets of gas that include oxidant, air, and/or flue gas into the fuel jet and entrained gas proceeding from the fuel nozzle and into the mixer aperture. Alternatively, mixing the fuel with oxidant, air, and/or flue gas can include applying a rotating electric field to the combustion reaction or the fuel jet above the conductive flame holder. Applying the rotating electric field can include applying a sequential waveform to a plurality of field electrodes.

Step 710 further includes mixing the fuel with oxidant, air, and/or flue gas above the conductive flame holder and below a location where the voltage or charge is applied to the combustion reaction (e.g., see FIG. 4). Alternatively, mixing the fuel with oxidant, air, and/or flue gas above the conductive flame holder can include mixing the fuel with oxidant, air, and/or flue gas above a location where the voltage or charge is applied to the combustion reaction or can include mixing the fuel with oxidant, air, and/or flue gas at a location substantially coincident with a location where the voltage or charge is applied to the combustion reaction (e.g., see FIGS. 5, 6).

Optionally, the fuel can also be mixed with oxidant, air, and/or flue gas below the conductive flame holder.

Steps 706 and 710 can be combined, optionally, such as with an embodiment 601 (see FIG. 6). Applying the voltage or charge to the combustion reaction and mixing the combustion reaction can be performed by at least an overlapping set of field electrodes. The mixing of fuel with oxidant of step 710 can include applying an electric field to the combustion reaction or to the fuel stream above the conductive flame holder. The electric field can be applied with a charger.

Proceeding to step 712, heat from the combustion reaction is output. For example, the heat can be output to heat a process material, to heat process equipment, to heat air and/or water, to generate electricity, to generate rotational energy, and/or to generate thrust.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. An electrically stabilized burner, comprising:

a fuel nozzle configured to provide a fuel jet flowing a fuel through a surrounding volume and entraining a first quantity of oxidant, air, or flue gas, wherein the fuel and the first quantity of oxidant, air, or flue gas are configured to be ignited to provide a combustion reaction;

a conductive flame holder configured for mounting proximate the fuel jet;

a charger disposed to cooperate with the conductive flame holder to cause a combustion reaction to be stabilized adjacent to the flame holder; and a mixer configured to mix the fuel and the first quantity of oxidant, air or flue gas above the conductive flame holder;

wherein the conductive flame holder, the mixer, and the charger are configured as an integrated unit;

and wherein the mixer further comprises:

a first electrical insulator disposed between the charger and the conductive flame holder;

a first power supply operatively coupled to the charger and operatively coupled to the conductive flame holder; and one or more fluid passages each configured to project a fluid jet tangentially into the combustion reaction, the one or more fluid passages being arranged to drive the combustion reaction in a stream-wise vortex.

2. The electrically stabilized burner of claim 1, wherein the mixer is configured to substantially maximize a mixing rate of the fuel and the first quantity oxidant, air, or flue gas without quenching the combustion reaction.

3. The electrically stabilized burner of claim 1, wherein the mixer is configured to mix the fuel and the first quantity oxidant, air, or flue gas at a mixing rate corresponding to a selected Damköhler number is between 1.1 and 1.7.

4. The electrically stabilized burner of claim 1, wherein the conductive flame holder is shaped to define an aperture configured to be supported peripherally and adjacent to the fuel jet.

5. The electrically stabilized burner of claim 4, wherein the mixer is configured or controlled to mix oxidant, air, or flue gas and fuel at a Damköhler number selected to form a compact combustion reaction disposed near the aperture.

6. The electrically stabilized burner of claim 1, wherein the charger and the conductive flame holder are configured to cooperate to maintain a current flow channel in the combustion reaction to or from the conductive flame holder; and wherein the current flow channel is selected to stabilize the combustion reaction adjacent to the conductive flame holder.

7. The electrically stabilized burner of claim 1, further comprising:

a support structure configured to hold the conductive flame holder at a distance from the fuel nozzle corresponding to a selected mixture of the fuel and the first quantity oxidant, air, or flue gas.

8. The electrically stabilized burner of claim 7, wherein the integrated unit includes the fuel nozzle and the support structure.

9. The electrically stabilized burner of claim 1, wherein the mixer includes one or more fluid passages integral to the first electrical insulator, the one or more fluid passages configured to inject a second quantity of any or a combination of oxidant, air, flue gas, or fuel into the combustion reaction to cause mixing.

10. The electrically stabilized burner of claim 1, wherein the first power supply is configured to cause the charger to apply a substantially constant charge to the combustion reaction.

11. The electrically stabilized burner of claim 1, wherein the first power supply is configured to cause the charger to apply a time-varying charge to the combustion reaction, wherein the time-varying charge includes a sign-varying charge.

12. The electrically stabilized burner of claim 1, wherein the charger is configured to be disposed in proximity to the combustion reaction; and wherein the combustion reaction is stabilized by current flow between the charger and the conductive flame holder.

13. The electrically stabilized burner of claim 12, further comprising:

a power supply controller operatively coupled to and forming a part of the first power supply, the power supply controller configured to control a voltage applied to the charger by the first power supply and configured to control a voltage applied to the conductive flame holder by the first power supply which is different than the voltage applied to the charger.

14. The electrically stabilized burner of claim 13, wherein the first power supply is configured to apply a substantially constant voltage to the charger.

15. The electrically stabilized burner of claim 13, wherein the first power supply is configured to apply a time-varying voltage to the charger.

16. The electrically stabilized burner of claim 13, wherein the conductive flame holder is held at a ground potential.

17. The electrically stabilized burner of claim 13, wherein the conductive flame holder is galvanically isolated from voltages other that voltages corresponding to charges received from the combustion reaction.

18. The electrically stabilized burner of claim 13, wherein the first power supply is configured to apply a voltage to the conductive flame holder opposite in sign from charges applied to the combustion reaction by the charger.

19. The electrically stabilized burner of claim 13, wherein the first power supply controller is configured to drive the charger to maintain a capacitance-coupled voltage relationship between the charger and the conductive flame holder.

20. The electrically stabilized burner of claim 1, wherein the mixer is formed integrally with the first electrical insulator.

21. The electrically stabilized burner of claim 13, further comprising:

a mixer controller operatively coupled to the mixer and configured to cause the mixer to mix the fuel and the first quantity of oxidant, air, or flue gas at a selected rate.

22. The electrically stabilized burner of claim 21, further comprising:

a control valve operatively coupled to the mixer controller and the one or more fluid passages;

wherein the mixer controller is configured to operate the control valve to control the flow of fluid through the one or more fluid passages to control the rate of mixing.

23. The electrically stabilized burner of claim 21, wherein the fluid jet includes any or a combination of fuel, oxidant, air, and/or flue gas.

24. The electrically stabilized burner of claim 21, wherein at least one fluid jet includes fuel; and wherein the fluid jet projected by the mixer is configured to act as a pilot flame if the fuel jet is reduced or stopped.

25. The electrically stabilized burner of claim 21, wherein the fuel jet includes a diverging fuel jet having a fuel concentration that varies proportionally with distance along the diverging fuel jet; and wherein the conductive flame holder is configured to be disposed at a distance along the diverging fuel jet such that a dilution in the fuel concentration corresponding to the fuel jet divergence plus a dilution caused by the fluid projected by the fluid passages resulting in fuel in the combustion reaction being burned near or above its lean flammability limit.

26. The electrically stabilized burner of claim 21, wherein the mixer includes a plurality of field electrodes operatively coupled to the mixer controller and disposed between the charger and the conductive flame holder; and wherein the mixer controller further includes a plurality of second power supplies each operatively coupled to one of each of the plurality of field electrodes.

27. The electrically stabilized burner of claim 26, wherein the mixer controller is configured to drive the plurality of field electrodes in a manner selected to cause the plurality of field electrodes to mix the fuel and the first quantity of oxidant, air, or flue gas at a selected rate of mixing.

28. The electrically stabilized burner of claim 27, wherein the mixer controller is configured to drive the plurality of field electrodes in a sequence selected to cause the plurality of field electrodes to form a stream-wise vortex in the combustion reaction to cause mixing of the fuel and the first quantity of oxidant, air, or flue gas.

29. The electrically stabilized burner of claim 28, wherein the first electrical insulator is configured to be disposed peripherally to the combustion reaction or to the fuel and the first quantity of oxidant, air, or flue gas and between the conductive flame holder and the charger, and;

wherein the plurality of field electrodes are at least partially carried by the first electrical insulator; and wherein the first electrical insulator and the plurality of field electrodes form an integrated unit or a portion of an integrated unit.

30. The electrically stabilized burner of claim 21, wherein the mixer includes a plurality of field electrodes operatively coupled to the mixer controller and disposed such that the charger is disposed between the plurality of field electrodes and the conductive flame holder.

31. The electrically stabilized burner of claim 30, wherein the mixer controller is configured to cause each of the plurality of second power supplies to separately apply a voltage to each one of the plurality of field electrodes in a manner selected to cause the plurality of field electrodes to mix the fuel and the first quantity of oxidant, air, or flue gas at a selected rate of mixing.

32. The electrically stabilized burner of claim 31, wherein the mixer controller is configured to drive each of the plurality of the second power supplies in a sequence selected to cause the plurality of field electrodes to form a stream-wise vortex in the combustion reaction to cause mixing of the fuel and the first quantity of oxidant, air, or flue gas.

33. The electrically stabilized burner of claim 28, further comprising a second electrical insulator configured to be disposed peripherally to the combustion reaction or to the fuel and the first quantity of oxidant, air, or flue gas such that the second electrical insulator is disposed above the charger;

wherein the plurality of field electrodes are at least partially carried by the second electrical insulator; and wherein the second electrical insulator and the plurality of field electrodes form an integrated unit or a portion of an integrated unit.

34. The electrically stabilized burner of claim 1, further comprising:

a second mixer disposed below the conductive flame holder and configured to mix the fuel and the first quantity of oxidant, air, or flue gas or to mix the fuel and flue gas.

* * * * *